United States Patent [19]

Bell

[11] 4,353,303

[45] Oct. 12, 1982

[54] PROJECTILE FOR DISPENSING GASEOUS MATERIAL

[75] Inventor: Frank H. Bell, Brigham City, Utah

[73] Assignee: Thiokol Corporation, Newtown, Pa.

[21] Appl. No.: 80,359

[22] Filed: Sep. 28, 1979

Related U.S. Application Data

[63] Continuation-in-part of Ser. No. 888,120, Mar. 20, 1978, abandoned.

[51] Int. Cl.[3] ..... F42B 13/46

[52] U.S. Cl. ..... 102/367; 102/334; 102/364

[58] Field of Search ..... 102/6, 56, 60, 66, 87, 102/90, 233, 367–370, 334, 364, 365

[56] References Cited

U.S. PATENT DOCUMENTS

| | | | |
|---|---|---|---|
| 1,039,850 | 10/1912 | Völler | 102/60 |
| 1,376,316 | 4/1921 | Chilowsky | 102/87 |
| 1,450,579 | 4/1923 | Chilowsky | 102/56 |
| 2,926,613 | 3/1960 | Fox | 60/270.5 |
| 3,201,936 | 8/1965 | Bancelin | 60/255 |
| 3,296,967 | 1/1967 | Bounds | 102/90 |
| 3,938,438 | 2/1976 | Anderson et al. | 102/233 |
| 3,960,087 | 6/1976 | Beatty | 102/66 |
| 3,986,456 | 1/1981 | Doin et al. | 102/531 |
| 3,994,234 | 11/1976 | Litz | 102/90 |

FOREIGN PATENT DOCUMENTS

| | | | |
|---|---|---|---|
| 206983 | 2/1909 | Fed. Rep. of Germany | 102/66 |
| 147104 | 6/1921 | United Kingdom | 102/66 |
| 484730 | 5/1938 | United Kingdom | 102/6 |

*Primary Examiner*—Harold J. Tudor

*Attorney, Agent, or Firm*—Edward E. McCullough; Thomas W. Brennan; Gerald K. White

[57] ABSTRACT

A hollow projectile, to be launched by rocket or fired from a cannon, has a central venturi tube that vents to the external environment near the forward end of the projectile. A pressurized liquid or a solid, combustible matrix that contains a gas or colloid producing material surrounds the venturi tube. This material is released through the venturi tube either by burning the matrix or by rupturing a diaphragm that retains the liquid. A timer, started by an accelerometer in response to the acceleration of the projectile when it is launched, fires an igniter or an explosive fuse to release the gaseous material. Spring loaded valve means, which normally closes the venturi tube, is forced open by gas pressure within the tube to permit discharge of gaseous material into the external environment. This valve means establishes a threshold pressure within the projectile that helps to ignite the matrix and to maintain combustion thereof, and to accelerate the gases being discharged from the projectile.

3 Claims, 5 Drawing Figures

PROJECTILE FOR DISPENSING GASEOUS MATERIAL

The Government has rights in this invention pursuant to Contract No. DAADO5-74-C-0794 awarded by the U.S. Army.

CROSS REFERENCE TO RELATED APPLICATIONS

This application is a continuation-in-part of application Ser. No. 888,120, filed Mar. 20, 1978, and titled "Cannon Projectile for Dispensing Atmospheric Colloids," now abandoned. Both applications have a common assignee.

BACKGROUND OF THE INVENTION

This invention relates broadly to projectiles. More specifically it relates to projectiles for dispensing atmospheric colloids or other gaseous material.

Projectiles for dispensing gaseous materials have many uses, such as dispersal of obscuring smokes or other gases for military purposes. More recent possible uses are cloud seeding and dispersal of finely divided barium, etc., for studies of the upper atmosphere.

Conventional cannon projectiles for dispensing gaseous material are either of a high velocity, bursting type, or of a low velocity, fin stabilized type. Hence, there is currently a military requirement for a high velocity, nonbursting projectile for this purpose that has inherent stability and a minimal number of moving parts.

SUMMARY OF THE INVENTION

The present invention, which fills this need in the prior art, is essentially a hollow projectile having a long, central venturi tube cantilevered to the forward end portion thereof and vented to the outer environment by symmetrical vents. A timer releases gaseous material, stored in the space surrounding the venturi tube, by incendiary or explosive means. A normally-closed, spring-loaded valve closes the venturi tube and is opened by internal pressure to permit discharge of the gaseous material.

An object of the invention is to provide a high-velocity, non-bursting projectile for dispensing gaseous materials. As used herein, the term "gaseous material" is intended to include material capable of producing gases, smokes and other atmospheric colloids, or any finely divided material for dispersal into the atmosphere or outer space. Another object of the invention is to provide such a projectile that has a minimum of moving parts. Another object of the invention is to provide such a projectile that has considerable inherent, aerodynamic stability. This is enhanced by the fact that, in one embodiment of the invention wherein the gaseous material is dispersed in a combustible matrix, the center of mass of the projectile gradually moves forward as the matrix is burned.

An important feature of the invention is that gaseous material can be discharged into an area of maximum turbulence about the projectile, which enhances dispersal of the material. This area lies between the bow and shoulder shock waves of the projectile in flight.

Another important feature of the invention is that, in one embodiment, the vents are canted rearwardly from the venturi tube; so that discharge of the gaseous material can also be used to contribute forward thrust to the projectile. This additional component of forward thrust flattens the trajectory of the projectile; so that the range over which the gaseous material is dispersed is not only extended, but dispersal may also be executed at a lower average altitude.

Other objects and advantages of the invention will be noted as the following detailed description is read with reference to the accompanying drawings. Each part number refers to the same part throughout the disclosure.

DESCRIPTION OF THE PREFERRED EMBODIMENTS

Figure 4:
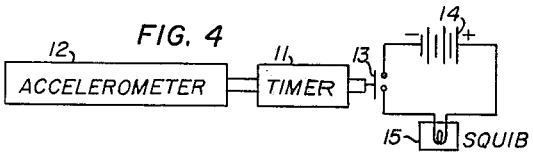
FIG. 4 is a schematic diagram of the actuation system.

In reference to the Figures, a housing 5 has the form of a hollow cylinder 6 closed at its forward end by an aerodynamically shaped nose cone 7. The aft closure 8, fastened to the cylinder 6 by screw threads 9, holds an actuation system 10, schematically shown in FIG. 4. It is made of commercially available parts connected together according to well-known practice in the ordnance art. A timer 11 is actuated by a linear accelerometer 12 requiring a force of at least 1,000 g's for actuation. Such devices are sold by Inertia Switch, Inc., of West Nyack, N.Y. The timer 11 closes a switch 13 of a circuit energized by a battery 14 to fire an electric squib 15 in the presence of pyrotechnic material 16. This material 16 produces flaming gases sufficient to ignite the matrix 17 and typically comprises boron pellets.

The matrix 17 contains the gaseous material that is to be dispensed by the projectile. As noted above, the material may be any gas or finely divided solid material and may be used for any of a great variety of purposes, such as smoke screens, target markers, signal flares, upper atmosphere and space research, and cloud seeding. A typical example of a composition useful as a smoke flare, cited in U.S. Pat. No. 3,668,026, comprises, in parts by weight:

Iodoform: 51
Ammonium perchlorate: 10
Potassium perchlorate: 6
Mobay R-18 (hydroxy-terminated polyester binder): 15
Triethylene glycol dinitrate: 17.2
Polymethylene polyphenylisocyanate: 0.8
Ferric acetylacetonate: 0.003

Figure 1:
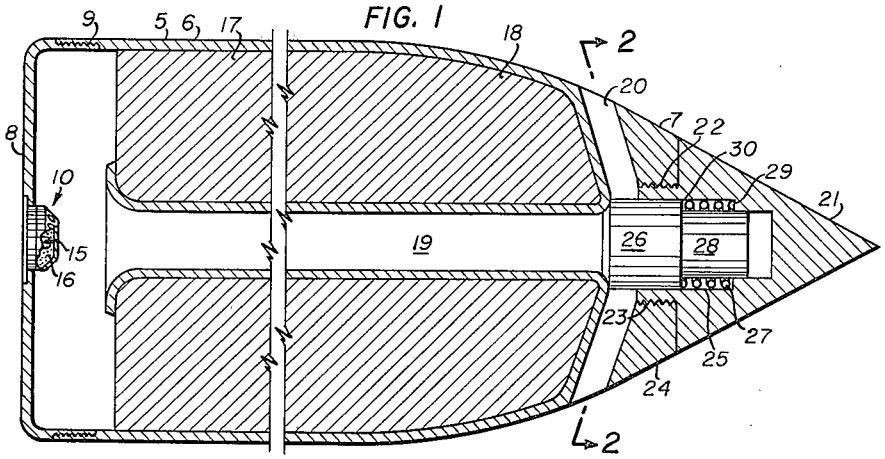
FIG. 1 is a longitudinal section of the invention.
Figure 2:
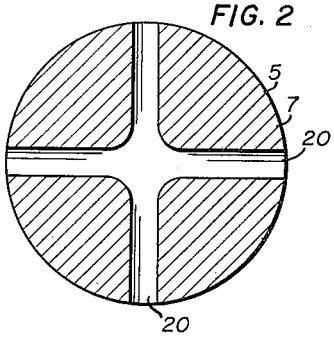
FIG. 2 is a full cross section taken on line 2—2 of FIG. 1.

This colloid-containing matrix 17 is cast and cured in the annular space 18 surrounding a long venturi tube 19 that is centrally fixed to the inside of the forward end portion 7 of the housing 5 and extends aftwardly therefrom. The venturi tube 19 forms an elongated throat and is vented to the outer atmosphere by radial passageways 20 extending from the venturi tube 19 through the otherwise solid nose cone 7. In the preferred embodiment shown in FIG. 1, the vents 20 are canted aftwardly from the venturi tube 19. This imparts an additional component of forward thrust to the projectile, that tends to flatten its trajectory and extend the range over which the gaseous material is dispersed.

In this preferred embodiment of the invention, a nose cone insert 21, comprising the forward end portion of the nose cone 7, has an axially-extending, cylindrical portion 22 having external threads that engage internal threads in a central hole 23 in the aft portion 24 of the nose cone 7. A central, cylindrical cavity 25 in the cylindrical portion 22 of the nose cone insert 21 holds a pintle valving member 26 and a compression spring 27 surrounding the shaft 28 thereof. The spring 27 is confined between shoulders 29 and 30 in the cavity 25 and on the pintle 26, forcing the latter to be seated in the forward end portion of the venturi tube 19, wherein it functions as a normally-closed valve.

It can be seen that, in this embodiment of the invention, the combustible matrix 17 supports the venturi tube 19 to prevent undesirable oscillations thereof. Also, since it is an end-burning matrix, the center of mass of the projectile gradually moves forward therein as the matrix is consumed. This tends to enhance stability of the projectile by insuring that the center of mass is always forward of the center of aerodynamic resistance thereof.

Figure 3:
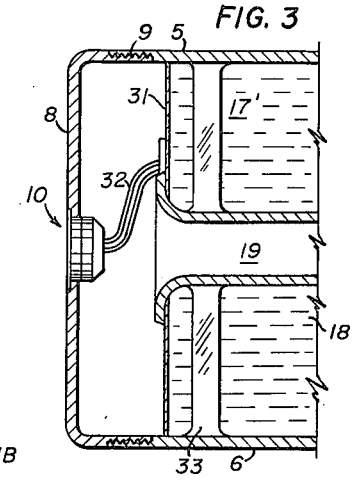
FIG. 3 is a fragmentary section, similar to the aft-end portion of FIG. 1 showing an alternate embodiment of the invention.

If, as shown in FIG. 3, the gaseous material 17 is a pressurized liquid 17' that becomes a gas when released, it is confined by a membrane or burst disk 31 that is explosively punctured or ruptured by an explosive fuse 32 in contact therewith. In this embodiment, an explosive fuse 32 or explosive puncture device (not shown) is used rather than the pyrotechnic material 16 shown in FIG. 4. The fuse 32 may be initiated by a primer if desired. This embodiment also incorporates a spider support 33 fixed to the aft-end portion of the venturi tube 19 and to the inner wall of the housing 5 to prevent undesirable oscillations of the venturi tube 19.

Figure 5:
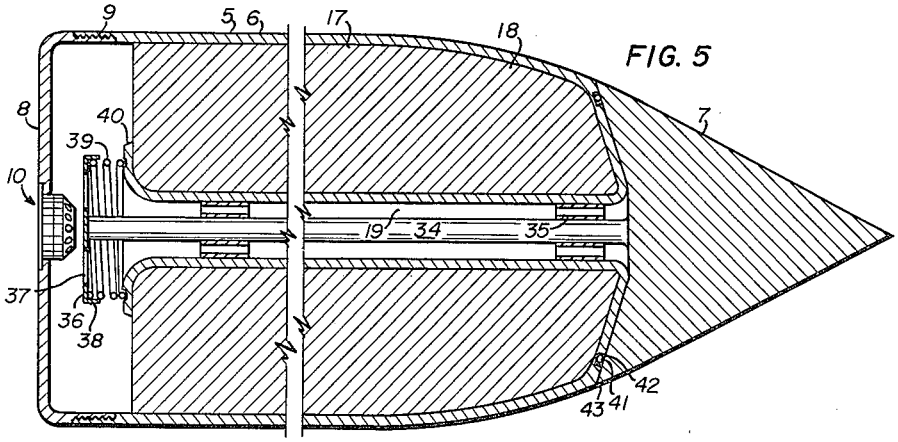
FIG. 5 is similar to FIG. 1, but shows another embodiment of the invention.

An alternate embodiment of the invention is shown in FIG. 5. In this embodiment, the nose cone insert 21 and its spring-loaded, pintle valve member 26 are eliminated. The entire nose cone 7 is separable from the housing 5 and functions as a valving member to open and close the forward end of the venturi tube 19. To function in this way, the nose cone 7 is centrally fixed to a long, aftwardly-extending rod 34 that is slidably supported in the venturi tube 19 by spider supports 35. The aft end of the rod 34 is centrally fixed to a small disk 36 having large perforations 37 therein and a short, forwardly-extending flange 38. A compression spring 39, confined between the disk 36 and the grooved, aft flange 40 of the venturi tube 19, maintains the nose cone 7 in a normally-closed position relative to the venturi tube 19.

An elastomeric ring 41, seated in an annular groove 42 in the forward end of the housing 5 functions as a seal between the nose cone 7 and the housing 5 to prevent dust and humidity from entering the projectile during storage. Also, the nose cone 7 presents a continuous, smooth, aerodynamic surface with the housing 5 to promote maximum range of the projectile until the matrix 17 is ignited and the nose cone 7 is forced slightly away from the housing 5 by the escaping gaseous material. The aft edge 43 of the nose cone 7 can be designed to promote maximum turbulance of the escaping gases for faster dispersion thereof into the external environment.

In operation, when the projectile is fired from a cannon or is rocket launched, the sudden acceleration causes the accelerometer 12 to start the timer 11. After a predetermined period of time has elapsed, for which the timer 11 has been set, it fires the electric squib 15. This squib, in turn, ignites either the pyrotechnic material 16 or the explosive fuse 32 to start the release of the gaseous material 17 or 17'. In the embodiment of the invention shown in FIGS. 1 and 5, the gaseous material to be dispensed is contained in a combustible matrix 17 and is released as this matrix is burned. Such matrices are designed for low flame temperatures, so that the materials to be dispensed will not be damaged as burning of the matrix progresses. Also, the high volumetric loading of the matrix with the relatively inert materials to be dispensed makes the matrix both difficult to ignite and difficult to maintain in combustion. Ignition is promoted and combustion is sustained by the preselected internal pressure maintained by the valve springs 27 and 39, since the gases produced by combustion must act against these springs before escaping to the external environment. Also, a positive, internal pressure gives greater velocity to the gaseous materials being discharged from the projectile, promoting better dispersion thereof into the external environment. In addition, there is a positive correlation between the internal pressure within the projectile and the burning rate of the matrix 17. Hence, the rate at which the matrix 17 will burn can be determined, within limits, by the design of the springs 27 and 39 . . . the stronger the spring, the higher the pressure and the faster the burning rate.

An invention has been described that provides an advance in the art of projectiles for dispensing gaseous materials. Although the embodiments have been described specifically with regard to detail, it should be noted that many details may be altered without departing from the scope of the invention, as it is defined in the following claims.

The invention claimed is:

1. A projectile for dispensing gaseous material to the external environment, comprising:

a closed, hollow, cylindrical housing having an opening in its forward end;

a central venturi tube inside the housing, fastened to the forward end thereof to encompass said opening and extending aftwardly therefrom, the aft end of said tube being in communication with the interior of the housing;

a nose cone forming at lease a portion of an aerodynamic, forward surface for the projectile but being separable from the forward end of the housing, against which it is normally seated;

a long rod centrally fixed at one end to the nose cone and extending centrally through the venturi tube;

spider supports in the venturi tube to support the rod for sliding motion therein;

a perforated disk centrally fixed to the aft end of the rod and having a short, forwardly extending, peripheral flange;

a compression spring confined between the aft end of the venturi tube and the perforated disk, being seated in a groove in the former and being retained by the peripheral flange on the latter, whereby the nose cone can function as a valving member against the venturi tube for controlled discharge of gaseous material when sufficient pressure occurs therein;

gaseous material to be dispensed to the external environment, stored in the space surrounding the venturi tube;

means for retaining the gaseous material in said space;

and means for releasing the gaseous material.

2. The projectile of claim 1 wherein the means for retaining the gaseous material is a solid, combustible matrix, throughout which the gaseous material is dispersed to be released on combustion of the matrix.

3. The projectile of claim 2 wherein the means for releasing the gaseous material is an igniter, adjacent thereto, and a timer operatively connected to the igniter for firing the igniter and capable of being started on launching of the projectile.

* * * * *